United States Patent [19]

Yan

[11] 4,379,747

[45] Apr. 12, 1983

[54] DEMETALATION OF HEAVY HYDROCARBON OILS

[75] Inventor: Tsoung Y. Yan, Philadelphia, Pa.

[73] Assignee: Mobil Oil Corporation, New York, N.Y.

[21] Appl. No.: 299,752

[22] Filed: Sep. 8, 1981

[51] Int. Cl.[3] ..... C10G 31/00; C10G 45/00

[52] U.S. Cl. ..... 208/251 H; 208/251 R

[58] Field of Search ..... 208/251 R, 251 H

[56] References Cited

U.S. PATENT DOCUMENTS

| | | | |
|---|---|---|---|
| 2,453,138 | 11/1948 | Kharasch | 208/251 |
| 3,798,157 | 3/1974 | Manzanilla et al. | 208/251 R |
| 3,893,912 | 7/1975 | Zimmerman | 208/251 R |
| 4,317,711 | 3/1982 | Yan | 208/8 LE |
| 4,334,976 | 6/1982 | Yan | 208/251 H |

*Primary Examiner*—Delbert E. Gantz
*Assistant Examiner*—Helane E. Maull
*Attorney, Agent, or Firm*—Charles A. Huggett; Michael G. Gilman; Charles J. Speciale

[57] ABSTRACT

This invention provides a method for coprocessing of heavy hydrocarbon oil and coal to achieve demetalation of the oil and liquefaction of the coal.

An essential aspect of the process is a two-stage visbreaking system in which the oil and coal are heat-treated respectively at the optimum severity for each, with little formation of coke byproduct.

17 Claims, 1 Drawing Figure

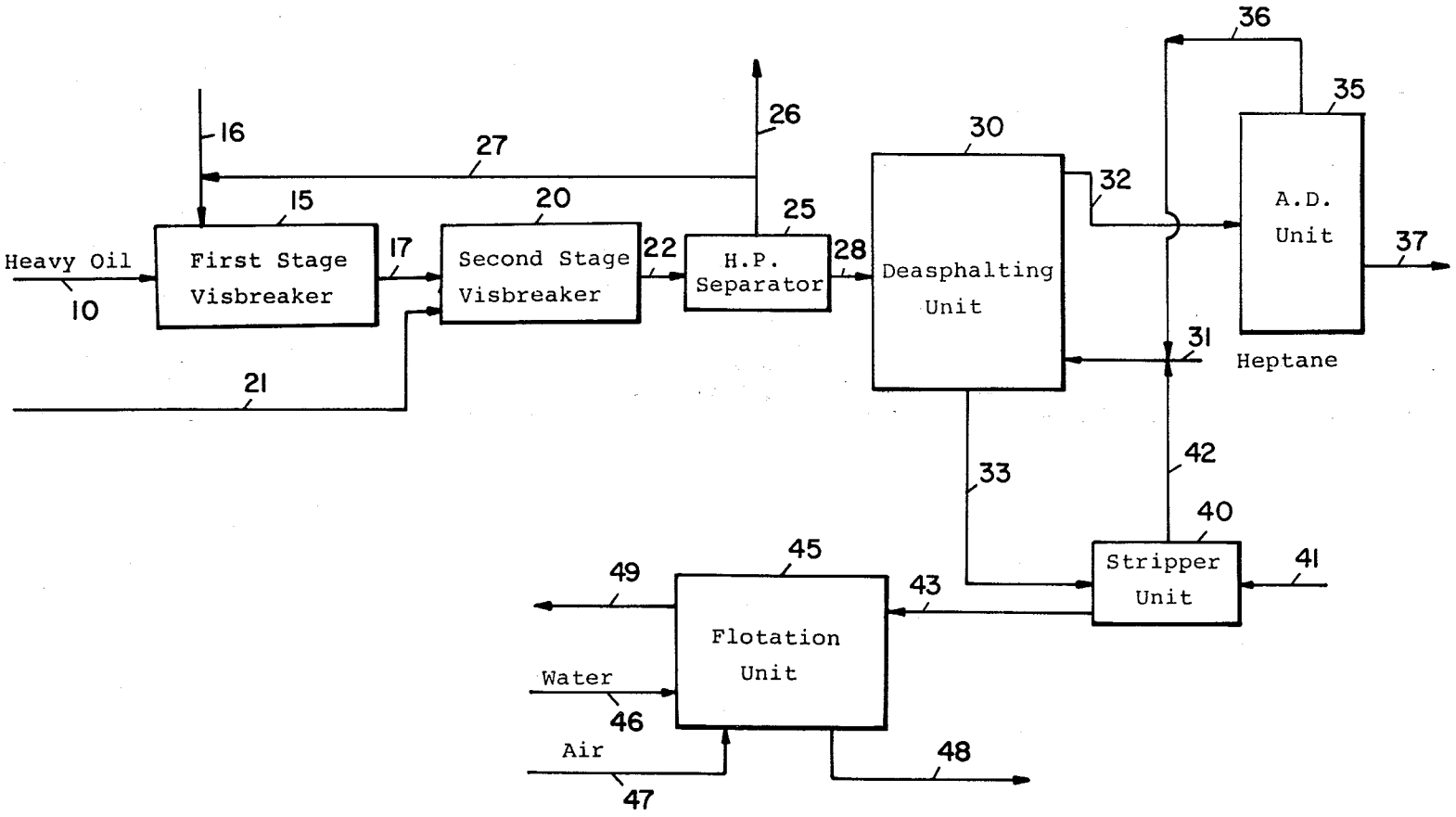
Heavy Oil
10
16
First Stage Visbreaker
15
17
21
27
Second Stage Visbreaker
20
22
H.P. Separator
25
26
28
Deasphalting Unit
30
32
33
A.D. Unit
35
36
37
Heptane
31
42
Stripper Unit
40
41
43
Flotation Unit
45
48
49
Water
46
Air
47

DEMETALATION OF HEAVY HYDROCARBON OILS

This patent application is related in subject matter to patent application Ser. No. 186,927 now U.S. Pat. No. 4,317,711, filed Sept. 12, 1980 by the same inventor.

BACKGROUND OF THE INVENTION

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes present.

The high metals content of the residual fractions generally preclude their effective use as chargestocks for subsequent catalytic processing such as catalytic cracking and hydrocracking, because the metal contaminants deposit on the special catalysts for these processes and cause the formation of inordinate amounts of coke, dry gas and hydrogen.

It is current practice to upgrade certain residual fractions by pyrolytic operation known as coking. In this operation the residuum is destructively distilled to produce distillates of low metals content and leave behind a solid coke fraction that contains most of the metals. Coking is typically carried out in a reactor or drum operated at about 800°-1100° F. temperature and a pressure of 1-10 atmospheres. The economic value of the coke byproduct is determined by its quality, particularly its sulfur and metals content. Excessively high levels of these contaminants makes the coke useful only as low-valued fuel. In contrast, cokes of low metals content, for example up to about 100 ppm (parts per million) by weight of nickel and vanadium, and containing less than about 2 weight percent sulfur may be used in high-valued metallurgical, electrical, and mechanical applications.

Presently, catalytic cracking is generally accomplished by utilizing hydrocarbon chargestocks lighter than residual fractions which usually have an API gravity less than 20. Typical cracking chargestocks are coker and/or crude unit gas oils, vacuum tower overhead, and the like, the feedstock having an API gravity from about 15 to about 45. Since these cracking chargestocks are distillates, they do not contain significant proportions of the large molecules in which the metals are concentrated. Such cracking is commonly carried out in a reactor operated at a temperature of about 800°-1500° F., a pressure of about 1-5 atmospheres, and a space velocity of about 1-1000 WHSV.

The amount of metals present in a given hydrocarbon stream is often expressed as a chargestock's "metal factor". This factor is equal to the sum of the metals concentrations, in parts per million, of iron and vanadium plus ten times the concentration of nickel and copper in parts per million, and is expressed in equation form as follows:

$$F_m = Fe + V + 10(Ni + Cu)$$

Conventionally, a chargestock having a metals factor of 2.5 or less is considered particularly suitable for catalytic cracking. Nonetheless, streams with a metals factor of 2.5-25, or even 2.5-50, may be used to blend with or as all of the feedstock to a catalytic cracker, since chargestocks with metals factors greater than 2.5 in some circumstances may be used to advantage, for instance with the newer fluid cracking techniques.

In any case, the residual fractions of typical crudes will require treatment to reduce the metals factor. As an example, a typical Kuwait crude, considered of average metals content, has a metals factor of about 75 to about 100. As almost all of the metals are combined with the residual fraction of a crude stock, it is clear that at least about 80 percent of the metals and preferably at least 90 percent needs to be removed to product fractions (having a metals factor of about 2.5-50) suitable for cracking chargestocks. It is also desirable to remove metals from hydrotreating feedstock to avoid catalyst poisoning.

The economic and environmental factors relating to upgrading of petroleum residual oils and other heavy hydrocarbon feedstocks have encouraged efforts to provide improved processing technology, as exemplified by the disclosures of various U.S. Pats. which include Nos. 3,696,027; 3,730,879; 3,775,303; 3,876,530; 3,882,049; 3,897,329; 3,905,893; 3,901,792; 3,964,995; 3,985,643; 4,016,067, and the like.

Accordingly, it is a main object of the present invention to provide an improved method for upgrading heavy hydrocarbon oils for use as liquid fuels or as demetalized feedstocks for refinery cracking operations.

It is a further object of this invention to provide a method for coprocessing residual oil and coal to yield distillate hydrocarbon products of low metal content.

Other objects and advantages of the present invention shall become apparent from the accompanying description and illustrated data.

DESCRIPTION OF THE INVENTION

One or more objects of the present invention are accomplished by the provision of a process for heavy hydrocarbon oil demetalation which comprises (1) heating a heavy hydrocarbon oil in a first stage visbreaking zone at a temperature between about 800°-1000° F. for a residence time between about 0.1-2 hours; (2) admixing the first stage visbroken effluent with particulate coal and heating the admixture in a second stage visbreaking zone at a temperature between about 700°-850° F. for a residence time between about 0.1-2 hours; and (3) recovering the second stage visbroken effluent and fractionating it to provide liquid and solid products.

In another embodiment, this invention provides a process for heavy hydrocarbon oil demetalation and coal liquefaction which comprises (1) heating a heavy hydrocarbon oil in a first stage visbreaking zone at a temperature between about 800°-1000° F. for a residence time between about 0.1-2 hours; (2) admixing the first stage visbroken effluent with particulate coal and heating the admixture in a second stage visbreaking zone at a temperature between about 700°-850° F. for a residence time between about 0.1-2 hours; (3) subjecting the visbroken admixture to solvent deasphalting to provide an oil fraction and a precipitated asphaltic solids fraction; and (4) distilling the said oil fraction to remove the deasphalting solvent and yield a demetalized liquid hydrocarbon product.

In a further embodiment, this invention provides a process for heavy hydrocarbon oil demetalation and coal liquefaction which comprises (1) heating a heavy hydrocarbon oil in a first stage visbreaking zone at a temperature between about 800°-1000° F. for a residence time between about 0.1–2 hours; (2) admixing the first stage visbroken effluent with particulate coal and heating the admixture in a second stage visbreaking zone at a temperature between about 700°–850° F. for a residence time between about 0.1–2 hours; (3) removing a light end fraction and then subjecting the second stage visbroken effluent to solvent deasphalting to provide an oil fraction and a precipitated asphaltic solids fraction; (4) distilling the said oil fraction to remove the deasphalting solvent and yield a demetalized liquid hydrocarbon product; and (5) treating the said asphaltic solids fraction under flotation conditions in an aqueous medium to separate a float phase of organic solids product from a sink phase of inorganic ash.

In addition to the methods of fractionating visbroken effluent product mixtures described above a present invention visbroken effluent recovered from the second stage visbreaking zone can be charged directly to a distillation unit where the visbroken effluent is fractionated into product streams comprising light and middle distillates, heavy gas and oil distillates, and residuum range oils containing unconverted coal and ash.

For purposes of the present invention, the term "heavy hydrocarbon oil" is meant to include petroleum oil residua and oil sand bitumen feedstocks, in which mixtures at least 75 weight percent of the constituents have a boiling point above about 700° F.

Typically, a heavy hydrocarbon oil suitable for treatment in accordance with the present invention has a metals content of at least 30 ppm, and a Conradson Carbon Residue content of at least 5 weight percent.

The coal component of the invention process can be any of a variety of carbonaceous materials which include bituminous and sub-bituminous types of coal, lignite, peat, and the like. The nominal analysis of typical coals are as follows:

| Sub-Bituminous | |
|---|---|
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for crushing and pulverizing coarse coal in the preparation of the particulate coal feed for the second stage visbreaking zone of the process. The crushing and grinding of the coal can be accomplished either in a dry state or in the presence of a liquid such as the heavy hydrocarbon oil being employed in the practice of the invention process. The average particle size of the coal feed is preferably below about 0.25 inches, such as finely divided bituminous coal which has a particle size of less than about 3 mesh (U.S. Sieve Series).

Visbreaking Conditions

An essential aspect of the present invention process relates to the use of a two-stage visbreaking system. The function of the two-stage visbreaking system is to overcome the disadvantages associated with the difference in inherent thermal reactivity exhibited by heavy hydrocarbon oil as compared to that of raw coal.

The incipient thermal cracking temperature of a residuum type of heavy hydrocarbon oil is about 800°–850° F. In order to achieve a high degree of demetalation, it is desirable to visbreak a heavy hydrocarbon oil above 800° F. In contradistinction, the incipient cracking temperature of a bituminous type coal is about 750°–800° F. Above about 800° F. there is a condensation of coal-derived oils into heavy materials, which leads to rapid coking and heater fouling.

In the practice of the present invention process as contemplated, the objective is to achieve extensive thermal cracking of the heavy hydrocarbon oil in the first stage visbreaking zone, with the least concomitant production of coke. During the thermal cracking a high level of fragmentation of the metal-containing constituents is also achieved.

In the second stage visbreaking zone, liquefaction and depolymerization of particulate coal occurs. As an additional activity in the second stage visbreaking zone, demetalation of the visbroken heavy hydrocarbon oil (i.e., the effluent from the first stage visbreaking zone) demetalizing rapidly because the oil is in contact with solid particles. Any coke which has formed effectively becomes incorporated in the surrounding matrix of coal and ash particles.

An essential aspect of the invention process is an improvement of visbreaker performance by optimization of operation severity for the heavy hydrocarbon oil in the first stage visbreaking zone, and for the particulate coal in the second stage visbreaking zone.

The severity of visbreaking zone conditions is expressed in terms of Severity(S), which is equal to the product of Soaking Factor and reaction time. The parameters are reaction temperature and reaction time.

Severity is conveniently expressed in terms of "equivalent reaction time in seconds" (ERT), as measured at 800° F.

The expressions "Severity"(S) and "Soaking Factor"(SF) as employed herein refers to the following algorithmic relationship of visbreaking parameters:

Severity = S = Soaking Factor(SF) × residence time $\theta$ $$SF_{800} = \int_{800}^{T_f} \left( \frac{k_T}{k_{800}} \right) dV$$

$SF_T$ = Soaking Factor relative to that at 800° F. (base temp.)

$(k_T/k_{800})$ = ratio of reaction rate constants at T and 800° F.

$T_f$ = coil outlet temperature, °F.

$$dV = \text{differential coil volume, } \frac{ft^3}{(bbl)\,(day)}$$

$\theta$ = residence time, seconds

As the severity level in a visbreaking zone increases, the coke formation tendency increases. This results in coking of the heater tubes and production of unstable visbroken effluent.

For purposes of the present invention process, the severity conditions in either of the visbreaking zones is limited to the highest level at which there is not more than about 1.0 weight percent coke formation during a visbreaking cycle, so as to ensure clean heater operation and the production of stable visbroken effluent. As described more fully below, the permissible level of coke formation is affected by the reactor design in a particular visbreaking zone.

In general, a heavy hydrocarbon oil is charged to the first stage visbreaking zone and heat treated at a temperature between about 800°-1000° F. and a pressure between about 400-2000 psi for a soak period between about 0.1-2 hours sufficient to convert at least about 60 weight percent of the heavy hydrocarbon oil to gas oil and heating oil range hydrocarbons, substantially without the formation of a deleterious quantity of solid coke. Optionally, a light hydrocarbon fraction can be removed from the visbroken effluent before further processing.

The visbroken effluent from the first stage visbreaking zone is slurried with particulate coal feedstock, either in an intermediate mixing zone or directly in the second stage visbreaking zone. The weight ratio of heavy hydrocarbon oil to coal is in the range between about 1.5-20:1.

The second stage visbreaking zone is operated at a temperature between about 700°-850° F. and a pressure between about 400-2000 psi for a soak period between about 0.1-2 hours sufficient to convert at least about 80 weight percent of the particulate coal (m.a.f.) to gaseous and liquid range hydrocarbons. The heavy hydrocarbon oil component of the oil/coal slurry fractions as a coal liquefaction solvent.

The weight hourly space velocity of feed through the two-stage visbreaking system normally will be in the range of about 1-100. It is preferred that the two-stage visbreaking operation is conducted under a hydrogen partial pressure between about 50-1500 psi. Addition of steam to the level of about 0.1-5 weight percent of the combined chargestock is also advantageous.

An advantage to be noted is that the presence of coal in the second stage visbreaking zone allows a higher permissible level of coke formation without equipment fouling, e.g., up to about 10 weight percent coke formation. The coke tends to deposit on the coal and ash particles rather than on the heater surfaces.

Preferably the second stage visbreaking treatment is conducted in a soaking drum type of reactor equipment, which can be operated without fouling even when there is substantial coke formation. The second stage visbreaking zone is operated under conditions which do not require the input of a large amount of external heat, so that there is no requirement for a large heat transfer surface in the second stage visbreaking zone.

Optionally, up to about 5 weight percent of particulate coal also can be introduced into the first stage visbreaking zone for the same purpose of suppressing the fouling of the equipment by coke formation.

Solvent Deasphalting Conditions

As one of the alternative procedures for fractionating the visbroken effluent recovered from the second stage visbreaking zone, the visbroken effluent is passed through a high pressure separator to vent the light end constituents. If hydrogen gas is present, the gas mixture is at least partially recycled to the first stage visbreaking zone. Alternatively, the gas mixture can be fractionated to recover the hydrogen gas for recycle.

The degassed visbroken effluent is then subjected to deasphalting fractionation with a light solvent. It is preferred that the deasphalting zone is a liquid-liquid countercurrent contacting system.

Suitable deasphalting solvents include liquefied normally gaseous hydrocarbons such as ethane, ethylene, propane, propylene, n-butane, isobutane, n-butylene, isobutylene, pentane and isopentane; cyclohexane, hexane; heptane; decane; octane; nonane; decalin; and mixtures thereof. The yield of liquid products extracted in the deasphalting operation can be increased if a light $C_6$-$C_{16}$ aromatic solvent is employed, e.g., benzene, toluene, xylene, mesitylene, naphthalene, and the like. In general, the deasphalting solvent of choice is a liquid hydrocarbon containing between about 3-12 carbon atoms.

The weight ratio of deasphalting solvent to visbroken admixture normally will be in the range between about 0.5-5:1.

The deasphalting treatment preferably is conducted at a temperature between about 100°-500° F. and at a sufficient pressure to maintain the deasphalting solvent in liquid form, and for a period between about 0.1-1.5 hours.

The liquid solvent extract phase and the precipitated asphaltic solids are withdrawn separately from the deasphalting zone. The solvent-oil effluent is charged to an atmospheric distillation tower to strip off the deasphalting solvent. The distillation bottom fraction is a demetalized liquid hydrocarbon product. The metals content of the liquid hydrocarbon product is less than about 50 ppm.

The quantity yield of the demetalized liquid hydrocarbon product on the average constitutes between about 45-85 weight percent of the total weight of heavy hydrocarbon oil and coal (m.a.f.) fed into the processing system.

The precipitated asphaltic solids fraction which is recovered tends to be saturated with adsorbed solvent and oil. Preferably the said asphaltic solids fraction is subjected to washing with light solvent or steam stripping to remove the adsorbed liquid and provide residual solids in a substantially dry form.

Ash Separation

Usually the stripped asphaltic solids recovered in the manner described above are in the form of a fine powder. In some cases mechanical crushing may be required, depending on the nature of the coal and the processing conditions.

As one alternative means of further processing, the powdered asphaltic solids are treated under flotation conditions in an aqueous medium to yield a float phase of organic solids product which has been separated from a sink phase of inorganic ash.

The flotation of the organic solids product is facilitated by air-frothing, particularly in combination with flotation aids such as ionic and nonionic surfactants, and the like.

The organic solids product on the average constitutes between about 10-50 weight percent of the total weight of heavy hydrocarbon oil and coal (m.a.f.) fed into the processing system. The organic solids product usually contains between about 5-30 weight percent of coke and unreacted coal.

Illustrative of the invention process, the drawing is a schematic representation of two-stage visbreaker, deasphalting and flotation units in series for coprocessing of heavy hydrocarbon oil and coal, with recovery and recycle of deasphalting solvent to the deasphalting unit, and recycle of hydrogen-rich gas to the first stage visbreaker unit.

The heavy hydrocarbon oil is an Arabian light vacuum residual fraction which has the following analysis:

| | |
|---|---|
| API, gravity | 8.3 |
| H, wt % | 10.67 |
| S, wt % | 3.93 |
| N, wt % | 0.28 |
| CCR, wt % | 16.13 |
| V, ppm | 68 |
| Ni, ppm | 17 |
| MW | 810 |

Referring to the drawing, the heavy hydrocarbon oil feedstock is charged through line 10 into First Stage Visbreaker Unit 15.

Hydrogen is entered into First Stage Visbreaker Unit 15 through line 16 to provide a hydrogen partial pressure of about 600 psig in the visbreaking zone at a temperature of about 900°–950° F. The weight hourly space velocity of the feedstock is about 20.

The first stage visbroken effluent is transferred through line 17 to Second Stage Visbreaker Unit 20, and concurrently powdered coal is charged via line 21 to Second Stage Visbreaker Unit 20 where a slurry admixture of oil and coal is formed.

The temperature in Visbreaker Unit 20 is maintained at about 800°–850° F., and the weight hourly space velocity of the oil-coal slurry is about 15. The weight ratio of oil to coal is about 2:1.

The coal is a High Volatile A bituminous stock which has been ground to a particle size of about 50 mesh. The coal has the following elemental analysis:

| | |
|---|---|
| Sulfur | 1.33% |
| Nitrogen | 1.63 |
| Oxygen | 7.79 |
| Carbon | 80.88 |
| Hydrogen | 5.33 |
| Ash | 2.77 |

The second stage visbreaker effluent is withdrawn from Visbreaker Unit 20 and passed through line 22 to High Pressure Separator 25, where a gaseous fraction is vented through line 26. A portion of the hydrogen-rich gas is recycled to First Stage Visbreaker Unit 15 via line 27.

The degassed visbreaker effluent is transferred through line 28 to the top section of Deasphalting Unit 30, where it flows downward in countercurrent contact with heptane which is fed into Deasphalting Unit 30 through line 31.

The weight ratio of heptane to visbroken admixture in the deasphalting zone is maintained at about 3:1, with the temperature being at about 300° F. and the pressure at about 600 psig. The liquid-liquid contact time in the deasphalting zone is about 10 minutes.

A liquid oil fraction of heptane-soluble hydrocarbon constituents exits from the top of Deasphalting Unit 30 and is passed through line 32 to Atmospheric Distillation Unit 35. Heptane is recovered from the distillation column and recycled via line 36 to Deasphalting Unit 30.

Demetalized liquid hydrocarbon product is withdrawn from the processing system via line 37. The liquid hydrocarbon product has a metals content of about 20 ppm, and a CCR weight percent of about 10. The yield of demetalized liquid hydrocarbon product constitutes about 70 weight percent of the total weight of heavy hydrocarbon oil and coal (m.a.f.) fed into the processing system.

Precipitated asphaltic solids are withdrawn from Deasphalting Unit 30 through line 33 and entered into Stripper Unit 40. The asphaltic solids contain small quantities of unreacted coal, inorganic ash and coke.

Steam is fed into Stripper Unit 40 through line 41 to remove residual heptane and oil from the asphaltic solids. The stripped liquid hydrocarbons are recycled through line 42 to Deasphalting Unit 30.

The stripped asphaltic solids are removed from Stripper Unit 40, mechanically crushed to a fine powder and transferred via line 43 to Flotation Unit 45.

Water is supplied to Flotation Unit 45 through line 46, and air is supplied through line 47. A small quantity of No. 2 oil is added to the aqueous medium in Flotation Unit 45 to facilitate the flotation of organic solids product.

An inorganic ash sink phase is withdrawn from Flotation Unit 45 through line 48 and discarded. An organic solids float phase is removed from the processing system via line 49.

The organic solids product constitutes about 20 percent of the total weight percent of heavy hydrocarbon oil and coal (m.a.f.) fed into the processing system. The organic solids product consists essentially of asphaltic material and unreacted coal.

As an alternative procedure to that illustrated in the drawing, the present invention provides a further processing embodiment for heavy hydrocarbon oil demetalation and coal liquefaction which comprises (1) heating a heavy hydrocarbon oil in a first stage visbreaking zone at a temperature between about 800°–1000° F. for a residence time between about 0.1–2 hours; (2) admixing the first stage visbroken effluent with particulate coal and a quantity of anti-solvent, and heating the admixture in a second stage visbreaking zone at a temperature between about 700°–850° F. for a residence time between about 0.1–2 hours to provide a visbroken admixture consisting of an oil fraction and a precipitated ash solids fraction; and (3) recovering and distilling the said oil fraction to remove the deashing anti-solvent and yield a demetalized liquid hydrocarbon product suitable as hydrotreating or FCC feedstock.

The term "anti-solvent" is meant to include a light paraffinic hydrocarbon such as n-pentane or n-hexane which serves to increase the precipitation of the ash solids and to increase the sedimentation rate by agglomeration of fine particles. The anti-solvent is employed in a quantity between about 0.1–0.5 weight percent, based on the weight of the oil phase.

The effluent from the second stage visbreaking zone is discharged as two streams, one of which is an overflow oil fraction and the other is an underflow ash solids fraction.

If a sufficiently large drum reactor is employed as the second stage visbreaking zone, then it is possible to dispense with the addition of anti-solvent as a deashing medium. The second stage visbreaking conditions can be controlled (with little or no input of external heat) in a manner such that the ash solids settle as a separate phase for recovery as an underflow stream. As a further option, a secondary settling drum can be incorporated into the system.

What is claimed is:

1. A process for heavy hydrocarbon oil demetalation which comprises (1) heating a heavy hydrocarbon oil in a first stage visbreaking zone at a temperature between about 800°-1000° F. for a residence time between about 0.1-2 hours; (2) admixing the first stage visbroken effluent with particulate coal and heating the admixture in a second stage visbreaking zone at a temperature between about 700°-850° F. for a residence time between about 0.1-2 hours; and (3) recovering the second stage visbroken effluent and fractionating it to provide liquid and solid products.

2. A process in accordance with claim 1 wherein the heavy hydrocarbon oil feedstock is a distillation residuum of crude oil.

3. A process in accordance with claim 1 wherein the particulate coal is finely divided bituminous coal.

4. A process in accordance with claim 1 wherein a light end fraction is removed from the first stage visbroken effluent before it is admixed with particulate coal in step (2).

5. A process for heavy hydrocarbon oil demetalation and coal liquefaction which comprises (1) heating a heavy hydrocarbon oil in a first stage visbreaking zone at a temperature between about 800°-1000° F. for a residence time between about 0.1-2 hours; (2) admixing the first stage visbroken effluent with particulate coal and heating the admixture in a second stage visbreaking zone at a temperature between about 700°-850° F. for a residence time between about 0.1-2 hours; (3) subjecting the visbroken admixture to solvent deasphalting to provide an oil fraction and a precipitated asphaltic solids fraction; and (4) distilling the said oil fraction to remove the deasphalting solvent and yield a demetalized liquid hydrocarbon product.

6. A process in accordance with claim 5 wherein the weight ratio of heavy hydrocarbon oil to coal in the step (2) admixture is in the range between about 1.5-10:1.

7. A process in accordance with claim 5 wherein the first and second stage visbreaking heat treatments are conducted under a hydrogen pressure between about 50-1500 psi, and at a weight hourly space velocity between about 1-100.

8. A process in accordance with claim 5 wherein the weight ratio of deasphalting solvent to visbroken admixture in step (3) is in the range between about 0.5-5:1.

9. A process in accordance with claim 5 wherein the deasphalting solvent in step (3) is liquid hydrocarbon containing between about 3-12 carbon atoms.

10. A process in accordance with claim 5 wherein the deasphalting treatment in step (3) is conducted at a temperature between about 100°-500° F. and at a sufficient pressure to maintain the deasphalting solvent in liquid form, and for a period between about 0.1-1.5 hours.

11. A process in accordance with claim 5 wherein the liquid hydrocarbon product recovered in step (3) has a metals content of less than about 50 ppm.

12. A process for heavy hydrocarbon oil demetalation and coal liquefaction which comprises (1) heating a heavy hydrocarbon oil in a first stage visbreaking zone at a temperature between about 800°-1000° F. for a residence time between about 0.1-2 hours; (2) admixing the first stage visbroken effluent with particulate coal and heating the admixture in a second stage visbreaking zone at a temperature between about 700°-850° F. for a residence time between about 0.1-2 hours; (3) removing a light end fraction and then subjecting the second stage visbroken effluent to solvent deasphalting to provide an oil fraction and a precipitated asphaltic solids fraction; (4) distilling the said oil fraction to remove the deasphalting solvent and yield a demetalized liquid hydrocarbon product, and (5) treating the said asphaltic solids fraction under flotation conditions in an aqueous medium to separate a float phase of organic solids product from a sink phase of inorganic ash.

13. A process in accordance with claim 12 wherein air-frothing is employed in the separation of the float and sink phases.

14. A process for heavy hydrocarbon oil demetalation and coal liquefaction which comprises (1) heat-treating a heavy hydrocarbon oil in a first stage visbreaking zone at the highest Severity that yields not more than about 1.0 weight percent coke formation; (2) admixing the first stage visbroken effluent with particulate coal and heat-treating the admixture in a second stage visbreaking zone at the highest Severity that yields not more than about 10.0 weight percent coke formation; and (3) recovering the second stage visbroken effluent and fractionating it to provide liquid and solid products.

15. A process in accordance with claim 14 wherein particulate coal in a quantity up to about 5 weight percent, based on the weight of heavy hydrocarbon oil feedstock, is included in the first stage visbreaking zone.

16. A process for heavy hydrocarbon oil demetalation and coal liquefaction which comprises (1) heating a heavy hydrocarbon oil in a first stage visbreaking zone at a temperature between about 800°-1000° F. and a residence time between about 0.1-2 hours; (2) admixing the first stage visbroken effluent with particulate coal and a quantity of anti-solvent, and heating the admixture in a second stage visbreaking zone at a temperature between about 700°-850° F. for a residence time between about 0.1-2 hours to provide a visbroken admixture consisting of an oil fraction and a precipitated ash solids fraction; and (3) recovering and distilling the said oil fraction to remove the deashing anti-solvent and yield a demetalized liquid hydrocarbon product.

17. A process in accordance with claim 16 wherein the quantity of anti-solvent employed in step (2) is in the range between about 0.1-0.5 weight percent, based on the weight of the oil phase.

* * * * *